US006557599B2

(12) United States Patent
Liao

(10) Patent No.: US 6,557,599 B2
(45) Date of Patent: May 6, 2003

(54) WOOD PLANING MACHINE WITH SHIFTABLE REDUCTION DRIVES OF A FEED-IN ROLLING MECHANISM

(76) Inventor: Juei-Seng Liao, No. 295, Sec. 1, Nanking E. Rd., Tung Dist., Taichung City (TW)

( * ) Notice: Subject to any disclaimer, the term of this patent is extended or adjusted under 35 U.S.C. 154(b) by 0 days.

(21) Appl. No.: 09/970,058

(22) Filed: Oct. 2, 2001

(65) Prior Publication Data

US 2003/0015252 A1 Jan. 23, 2003

(30) Foreign Application Priority Data

Jul. 18, 2001 (TW) ..... 90212152 U

(51) Int. Cl.[7] ..... B27C 1/00

(52) U.S. Cl. ..... 144/117.1; 74/22 A; 74/63; 74/473.1; 144/130

(58) Field of Search ..... 74/22 R, 22 A, 74/25, 27, 63, 473.1; 144/114.1, 117.1, 129, 130

(56) References Cited

U.S. PATENT DOCUMENTS 2,873,776 A * 2/1959 Buttke ..... 144/117.1
3,291,170 A * 12/1966 Nishimura ..... 144/117.1
3,718,168 A * 2/1973 Berends ..... 144/117.1
4,422,486 A * 12/1983 Maret ..... 144/117.1
4,886,099 A * 12/1989 de Abreu ..... 144/117.1
5,284,192 A * 2/1994 Sato et al. ..... 144/117.1

* cited by examiner

*Primary Examiner*—W. Donald Bray
(74) *Attorney, Agent, or Firm*—Knobbe, Martens, Olson & Bear, LLP

(57) ABSTRACT

A wood planing machine includes a first drive transmission member transmitting a rotating force of a cutting member to a first transmission shaft with two gears mounted thereon. Two gears are splined on a second transmission shaft and are movable along an axis of the shaft such that one gear meshes with a respective one of the gears on the first transmission shaft so as to result in two reduction drives of the second transmission shaft. A second drive transmission member transmits one of the reduction drives to a feed-in rolling member. An actuating member is rotated with a rotating force which is transformed by a cam member into a translation force to move the gears on the second transmission shaft.

7 Claims, 8 Drawing Sheets

WOOD PLANING MACHINE WITH SHIFTABLE REDUCTION DRIVES OF A FEED-IN ROLLING MECHANISM

CROSS-REFERENCE TO RELATED APPLICATION

This application claims priority of Taiwan patent Application No. 090212152, filed on Jul. 18, 2001.

BACKGROUND OF THE INVENTION

1. Field of the Invention

This invention relates to a wood planing machine, more particularly to a wood planing machine with two shiftable reduction drives of a feed-in rolling mechanism.

2. Description of the Related Art

Referring to FIG. 1, a conventional wood planing machine 10 is shown to include a mounting frame 14 on which a cutting member (not shown) is rotatably mounted. A worktable 13 is disposed under and is movable uprightly relative to the mounting frame 14 for supporting a workpiece thereon. A drive transmission member 15 is disposed to transmit the rotating force of the cutting member to a feed-in rolling member (not shown). The drive transmission member 15 includes a first transmission shaft 151 which has a small gear 16 mounted removably thereon, and a second transmission shaft 152 which has a large gear 17 mounted removably thereon and meshing with the small gear 16. When it is desired to change the reduction drive of the feed-in rolling member, the gears 16,17 are needed to be removed from the transmission shafts 151,152, and replaced by two suitable gears (not shown) according to an assembly table 18, thereby resulting in inconvenient operation.

SUMMARY OF THE INVENTION

The object of the present invention is to provide a wood planing machine which is conveniently operated when shifting the reduction drives of the feed-in rolling member.

According to this invention, the wood planing machine includes a mounting frame which has right and left sides spaced apart from each other in a longitudinal direction. A rotatable cutting member has two ends which are mounted rotatably on the right and left sides to define a rotating axis in the longitudinal direction. A worktable is disposed under and is movable relative to the cutting member in an upright direction for supporting a workpiece thereon. The worktable has feed-in and take-out sides opposite to each other in a transverse direction relative to both the longitudinal and upright directions. A first transmission shaft extends in the longitudinal direction, and is mounted rotatably on the left side about a first axis parallel to the rotating axis. First and second gears are mounted on and are rotated with the first transmission shaft about the first axis, and have different numbers of teeth. A first drive transmission member is disposed to transmit the rotating force of the cutting member to the first transmission shaft. A second transmission shaft extends in the longitudinal direction, and is mounted rotatably on the left side about a second axis parallel to the first axis. A sleeve is splined on and is rotated with the second transmission shaft. Third and fourth gears are secured respectively on two ends of the sleeve, and have different numbers of teeth such that the sleeve, along with the third and fourth gears, is shiftable along the second axis relative to the second transmission shaft between a first position, where the third gear meshes with the first gear so as to result in a first reduction drive of the second transmission shaft, and a second position, where the fourth gear meshes with the second gear so as to result in a second reduction drive of the second transmission shaft. A feed-in rolling member extends in the longitudinal direction, and is mounted rotatably on the right and left sides about a first rolling axis parallel to the first axis and proximate to the feed-in side. A second drive transmission member is disposed to transmit one of the first and second reduction drives of the second transmission shaft to the feed-in rolling member. An actuating member has an inner actuating end which is rotatably mounted in the mounting frame about an operating axis radial to the second axis of the second transmission shaft, and an outer operating end which extends along the operating axis and outwardly of the mounting frame so as to externally operate the inner actuating end to rotate with a rotating force. A cam member is disposed to transform the rotating force of the inner actuating end into a translational force for moving the sleeve along the second axis between the first and second positions.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
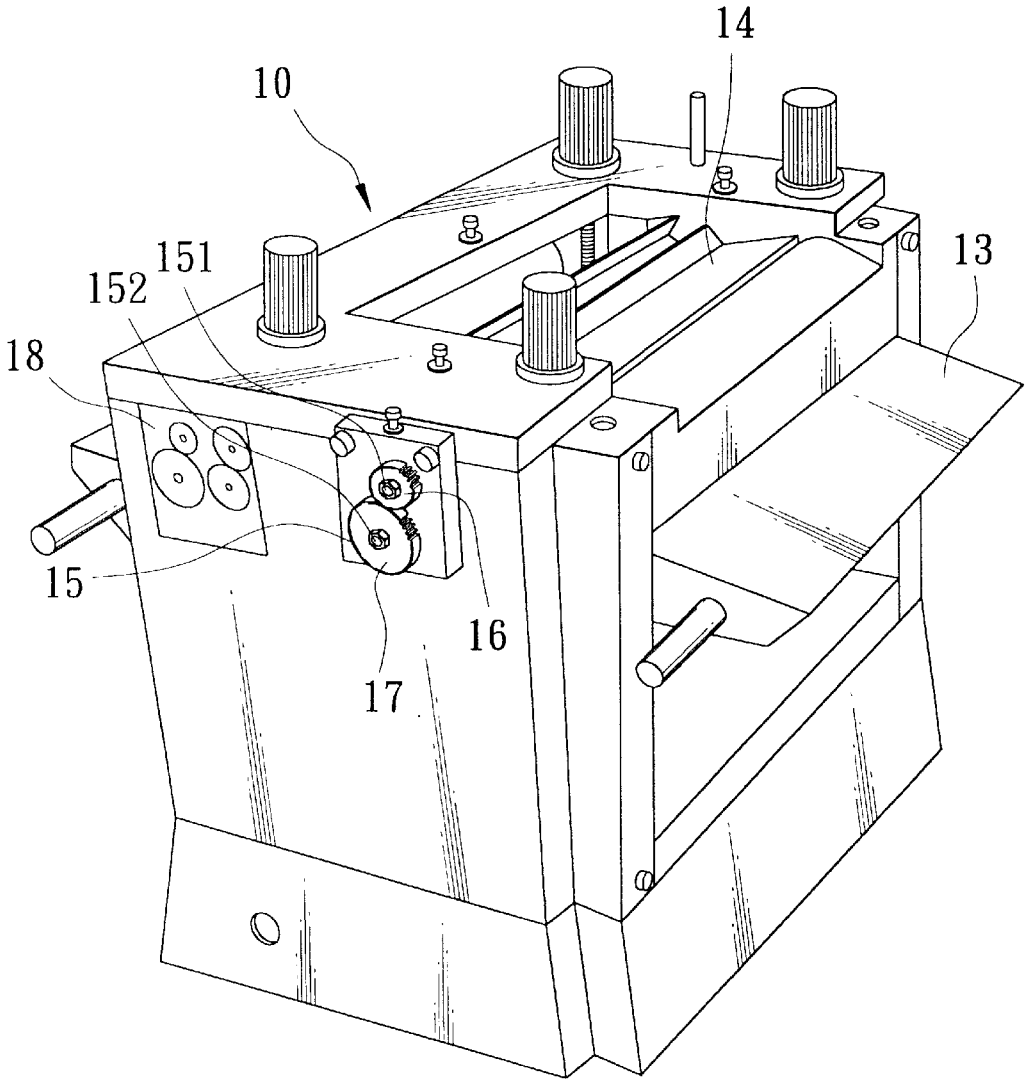
FIG. 1 PRIOR ART
FIG. 1 is a perspective view of a conventional wood planing machine.
Figure 2:
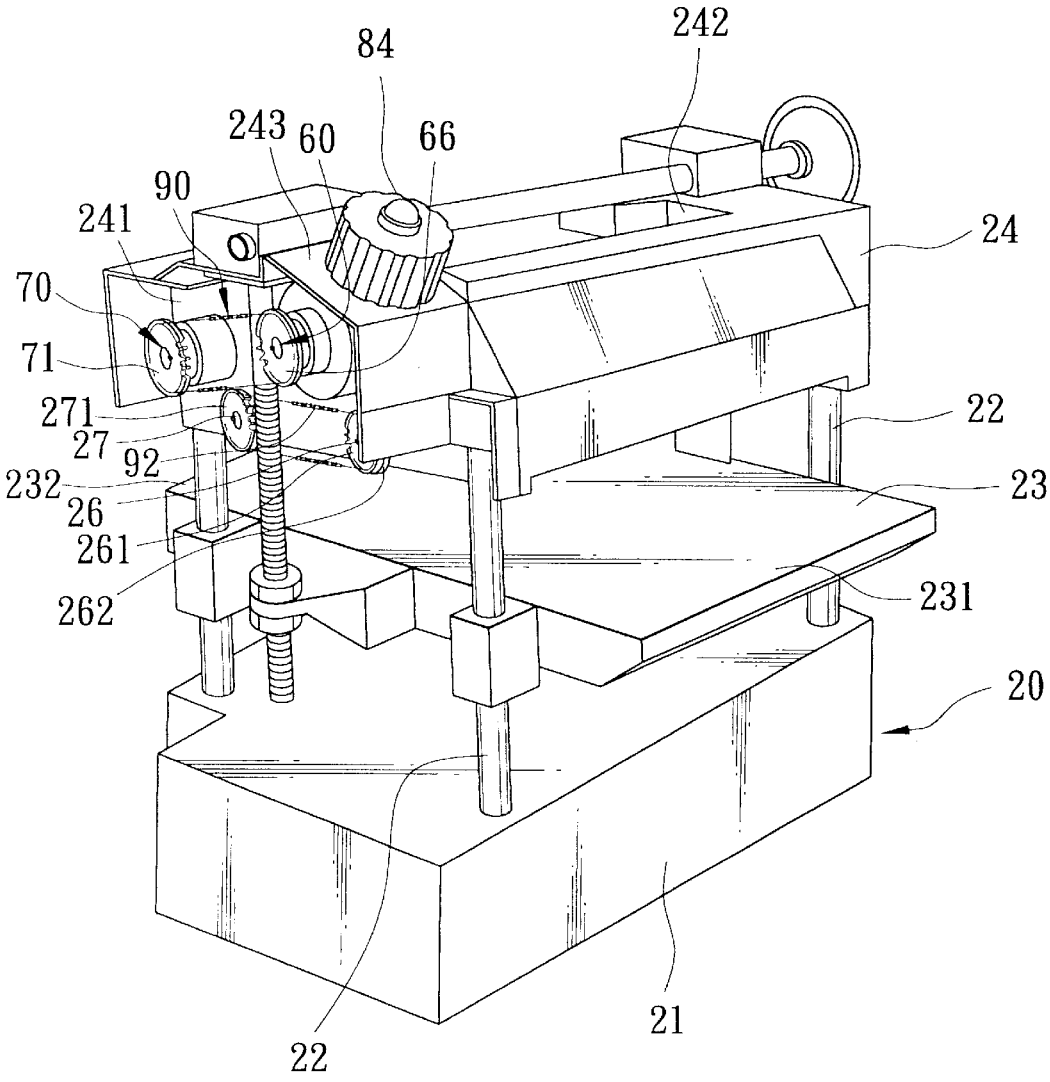
FIG. 2 is a perspective view of a preferred embodiment of a wood planing machine according to this invention.
Figure 3:
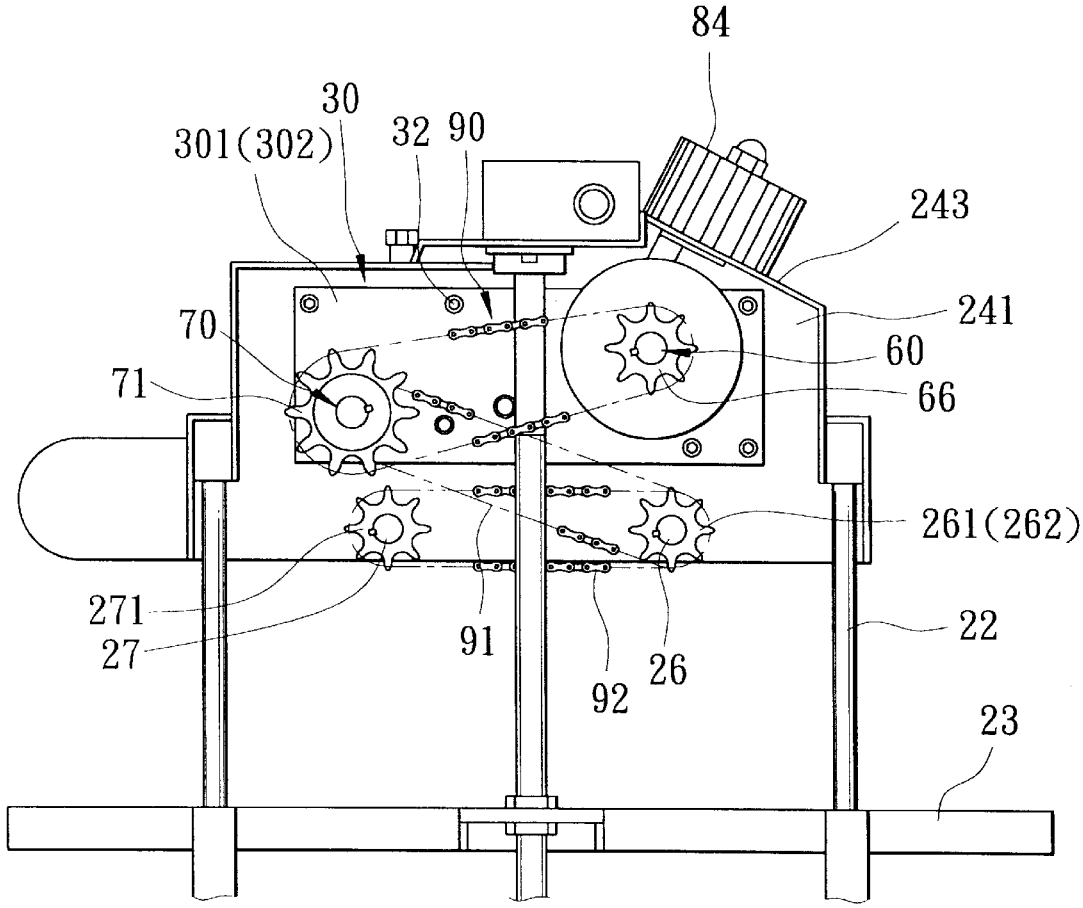
FIG. 3 is a side view of the preferred embodiment.
Figure 4:
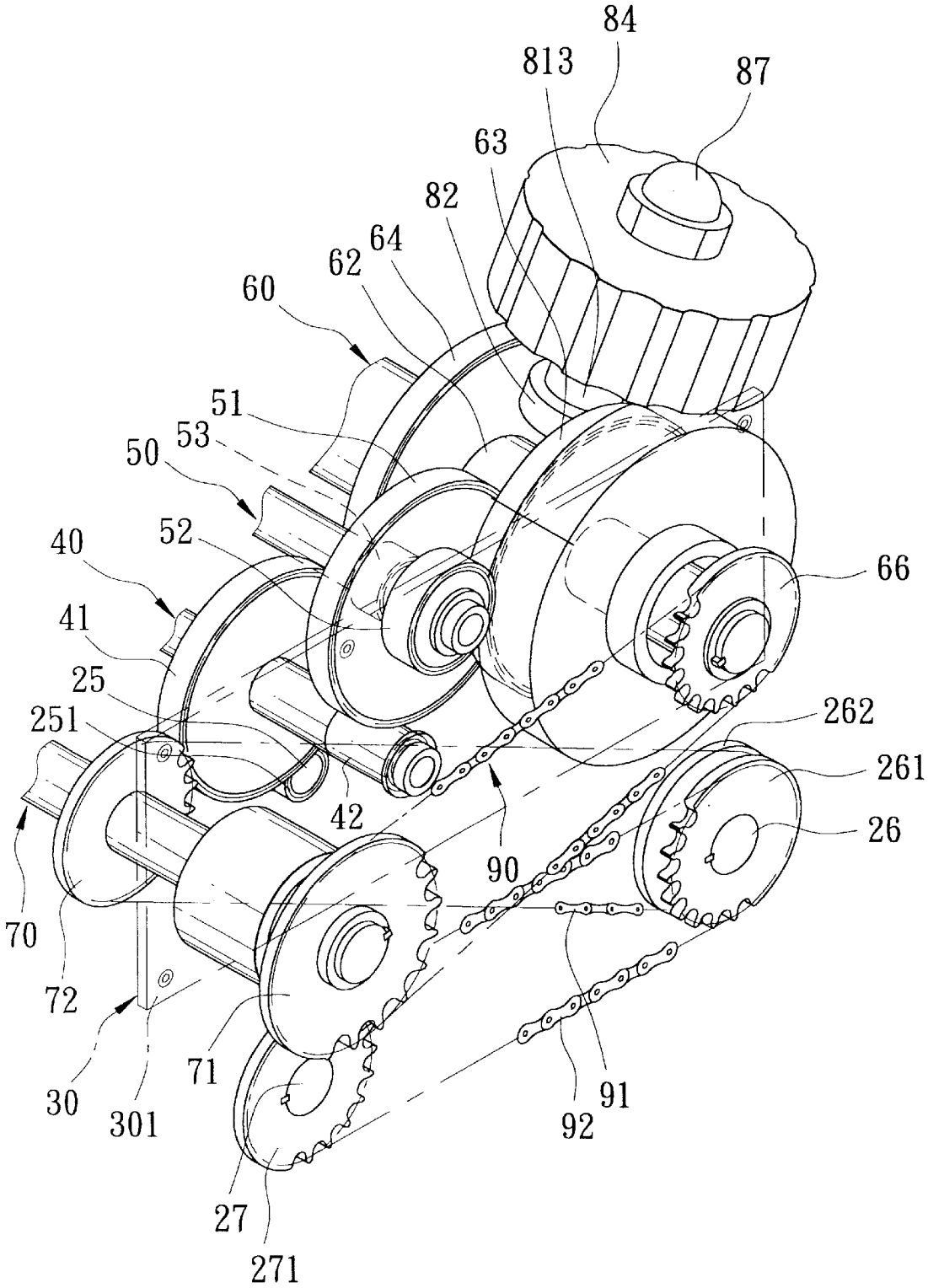
FIG. 4 is a perspective view showing a drive transmission device transmitting a rotation force of a cutting member to a feed-in rolling mechanism.
Figure 5:
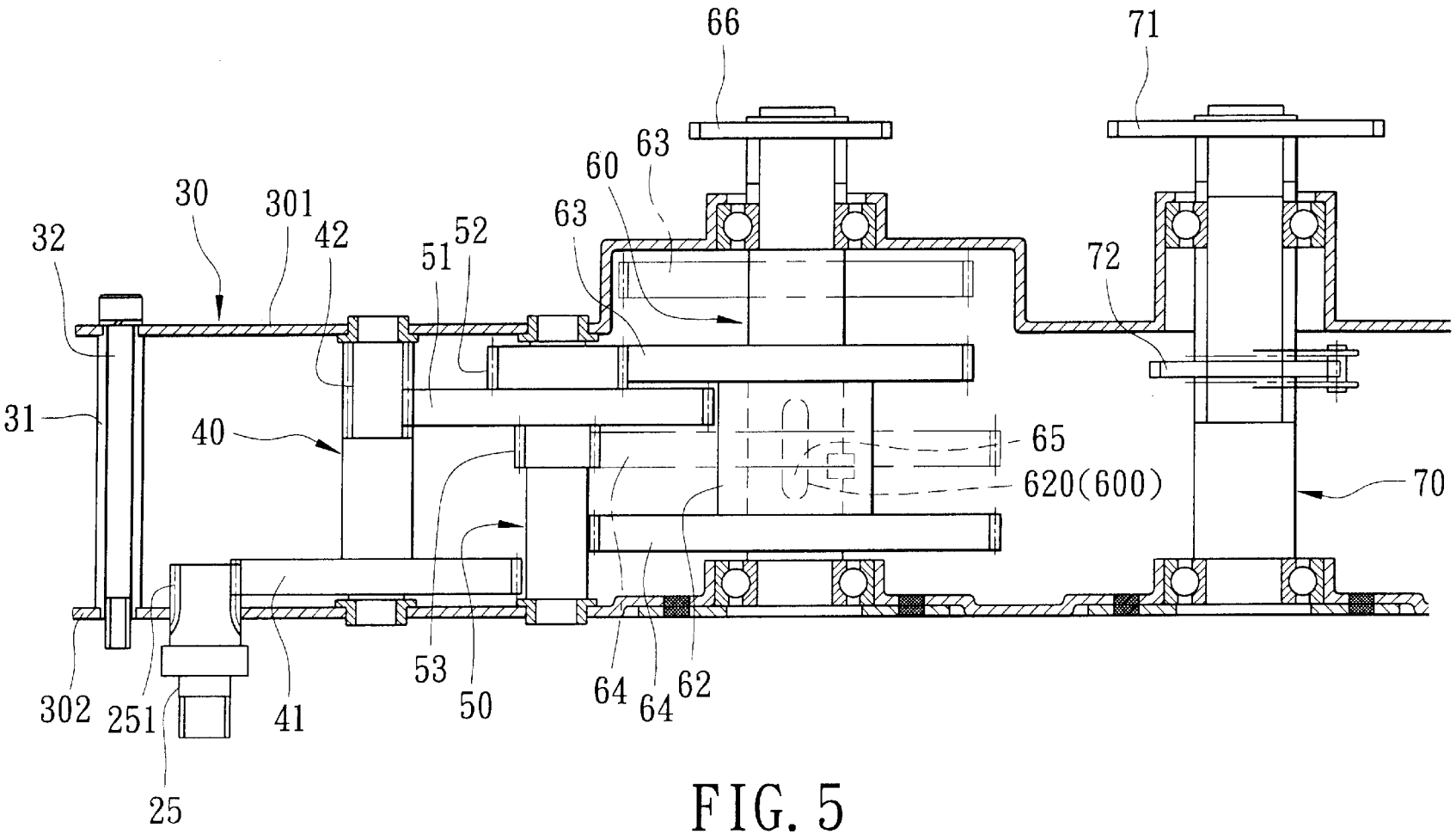
FIG. 5 is a schematic partly sectional view of the drive transmission device.

Referring to FIGS. 2, 3 and 4, the preferred embodiment of the wood planing machine according to the present invention is shown to comprise a frame body 20 which includes a base 21, four upright posts 22 that extend in an upright direction from the base 21, and a mounting frame 24 that is secured on upper ends of the posts 22 and that defines right and left sides 242,241 spaced apart from each other in a longitudinal direction. A rotatable cutting member 25, as shown in FIGS. 4 and 5, has two ends which are mounted rotatably on the right and left sides 242,241 to define a rotating axis in the longitudinal direction, and which are driven by a motor (not shown) to rotate with a rotating force. A worktable 23 is disposed under and is movable relative to the cutting member 25 in the upright direction for supporting a workpiece (not shown) thereon. The worktable 23 has feed-in and take-out sides 231,232 opposite to each other in a transverse direction relative to both the longitudinal and upright directions.

Feed-in and take-out rolling members 26,27 extend in the longitudinal direction, and are mounted rotatably on the right and left sides 242,241 about first and second rolling axes parallel to the rotating axis and proximate to the feed-in and take-out sides 231,232, respectively. The feed-in and take-out rolling members 26,27 are spaced apart from each other in the transverse direction so as to facilitate the feed-in and take-out movement of the workpiece.

As shown in FIG. 5, the mounting frame 24 has a support frame 30 which is secured on the left side 241 and which includes outer and inner plates 301,302 that are spaced apart by sleeves 31 with screws 32 in the longitudinal direction.

With reference with FIGS. 4 and 5, a drive transmission device is mounted on the support frame 30, and includes first and second transmission shafts 50,60, first, second, third and fourth gears 52,53,63,64, first and second drive transmission members.

The first transmission shaft 50 extends in the longitudinal direction, and is mounted rotatably on the outer and inner plates 301,302 about a first axis parallel to the rotating axis of the cutting member 25. The first and second gears 52,53 are mounted on and are rotated with the first transmission shaft 50 about the first axis. The first and second gears 52,53 have different numbers of teeth, such as 26 and 15 teeth, respectively.

The first drive transmission member includes a 12-teeth fifth gear 251 which is mounted on and which is rotated with the cutting member 25, a third transmission shaft 40 which extends in the longitudinal direction and which is mounted rotatably on the outer and inner plates 301,302 about a third axis parallel to the first axis, and 56-teeth sixth and 12-teeth seventh gears 41,42 which are mounted on and which are rotated with the third transmission shaft 40 and which are spaced apart from each other in the longitudinal direction. The sixth gear 41 meshes with the fifth gear 251. A 60-teeth eighth gear 51 is mounted on and is rotated with the first transmission shaft 50, and meshes with the seventh gear 42 so as to transmit the rotating force of the cutting member 25 to the first transmission shaft 50.

The second transmission shaft 50 extends in the longitudinal direction, and is mounted rotatably on the inner and outer plates 301,302 about a second axis parallel to the first axis. A sleeve 62 is splined on and is rotated with the second transmission shaft 60, and has two ends opposite to each other in the longitudinal direction. In particular, the second transmission shaft 60 and the sleeve 62 have keyways 600,620 formed therein and extend along the second axis. A key 65 is inserted into the keyways 600,620 such that the sleeve 62 is movable relative to the second transmission shaft 60 along the second axis.

The third and fourth gears 63,64 are secured on the two ends of the sleeve 62, and have different numbers of teeth, such as 69 and 80 teeth. As such, the sleeve 62, along with the third and fourth gears 63,64, is shiftable along the second axis relative to the second transmission shaft 60 between a first position (as indicated by the solid line in FIG. 5), where the third gear 63 meshes with the first gear 52 so as to result in a first reduction drive of the second transmission shaft 60, and a second position (as indicated by the dotted line in FIG. 5), where the fourth gear 64 meshes with the second gear 53 so as to result in a second reduction drive of the second transmission shaft 60. The gears form a reducing gear train from the cutting member 25 to the second transmission shaft 60.

The second drive transmission member includes a first chain wheel 66 which is mounted on and which is rotated with the second transmission shaft 60 and outwardly of the outer plate 301, and a fourth transmission shaft 70 which extends in the longitudinal direction and which is mounted rotatably on the outer and inner plates 301,302 about a fourth axis parallel to the first axis. Second and third chain wheels 71,72 are mounted on and are rotated with the fourth transmission shaft 70, and are respectively outwardly and inwardly of the outer plate 301. As shown in FIG. 4, a first chain 90 is trained on the first and second chain wheels 66,71 so as to transmit the rotating force of the second transmission shaft 60 to the fourth transmission shaft 70. In addition, a fourth chain wheel 262 is mounted on and is rotated with the feed-in rolling member 26. A second chain 91 is trained on the third and fourth chain wheels 72,262 to transmit the rotating force of the fourth transmission shaft 70 to the feed-in rolling member 26. As such, by the action of the second drive transmission member, one of the first and second reduction drives of the second transmission shaft 60 can be transmitted to the feed-in rolling member 26. Moreover, a third drive transmission member includes a fifth chain wheel 261 which is mounted on and which is rotated with the feed-in rolling member 26 and which is spaced apart from the fourth chain wheel 262 in the longitudinal direction, a sixth chain wheel 271 which is mounted on and which is rotated with the take-out rolling member 27, and a third chain 92 which is trained on the fifth and sixth chain wheels 261,271 to transmit the rotating force of the feed-in rolling member 26 to the take-out rolling member 27.

Figure 6:
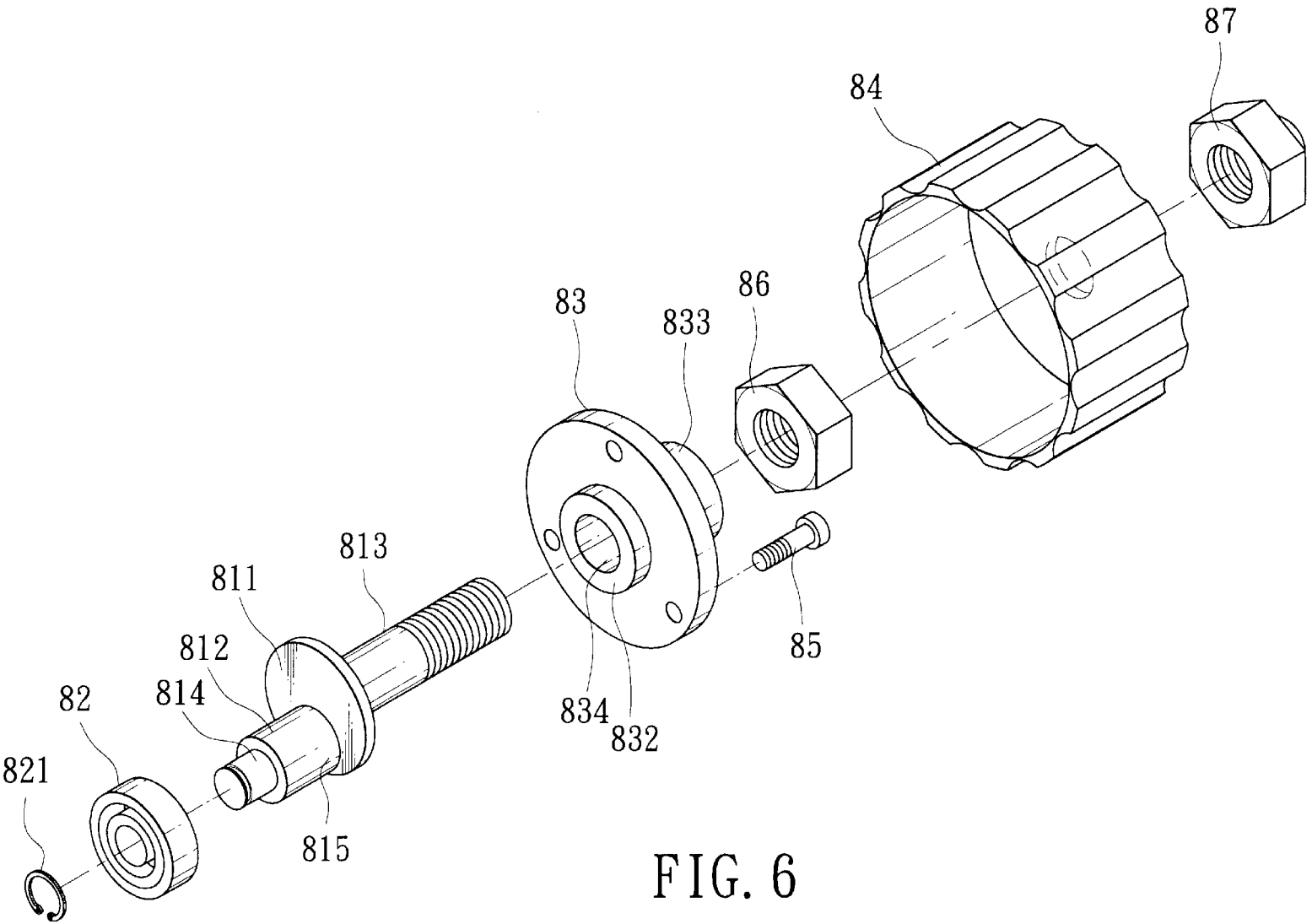
FIG. 6 is an exploded perspective view of a cam member and an actuating member of the preferred embodiment.
Figure 7:
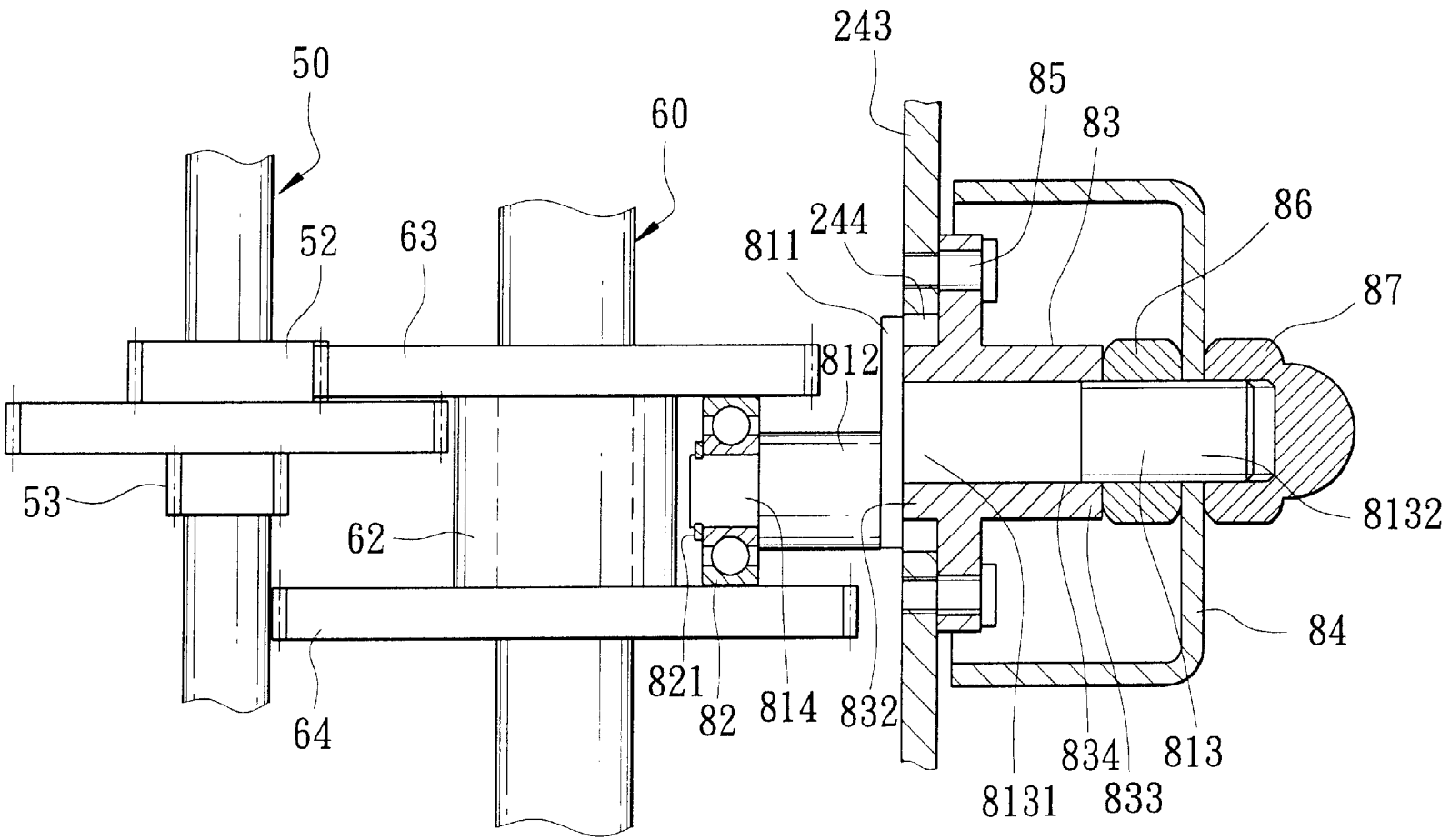
FIG. 7 is a schematic partly sectional view showing a drive transmission shaft of the drive transmission mechanism in a first position.

As shown in FIGS. 6 and 7, a positioning sleeve 83 is secured on a top portion 243 of the mounting frame 24 by means of screws 85, and has an inner tubular portion 832 which is inserted into a hole 244 in the top portion 243, and an outer tubular portion 833 which extends outwardly of the top portion 243 and which has an axial hole 834 that extends through the inner tubular portion 832 and that defines an operating axis radial to the second axis of the second transmission shaft 60. An elongated actuating member 813 has an inner actuating end 8131 which is rotatably mounted in the axial hole 834 about an operating axis, and a threaded outer operating end 8132 which extends from the inner actuating end 8131 along the operating axis and outwardly of the outer tubular portion 833. An operating knob 84 is sleeved securely on the outer operating end 8132 using two screw nuts 86,87 so as to externally operate the inner actuating end 8131 to rotate with a rotating force.

Figure 8:
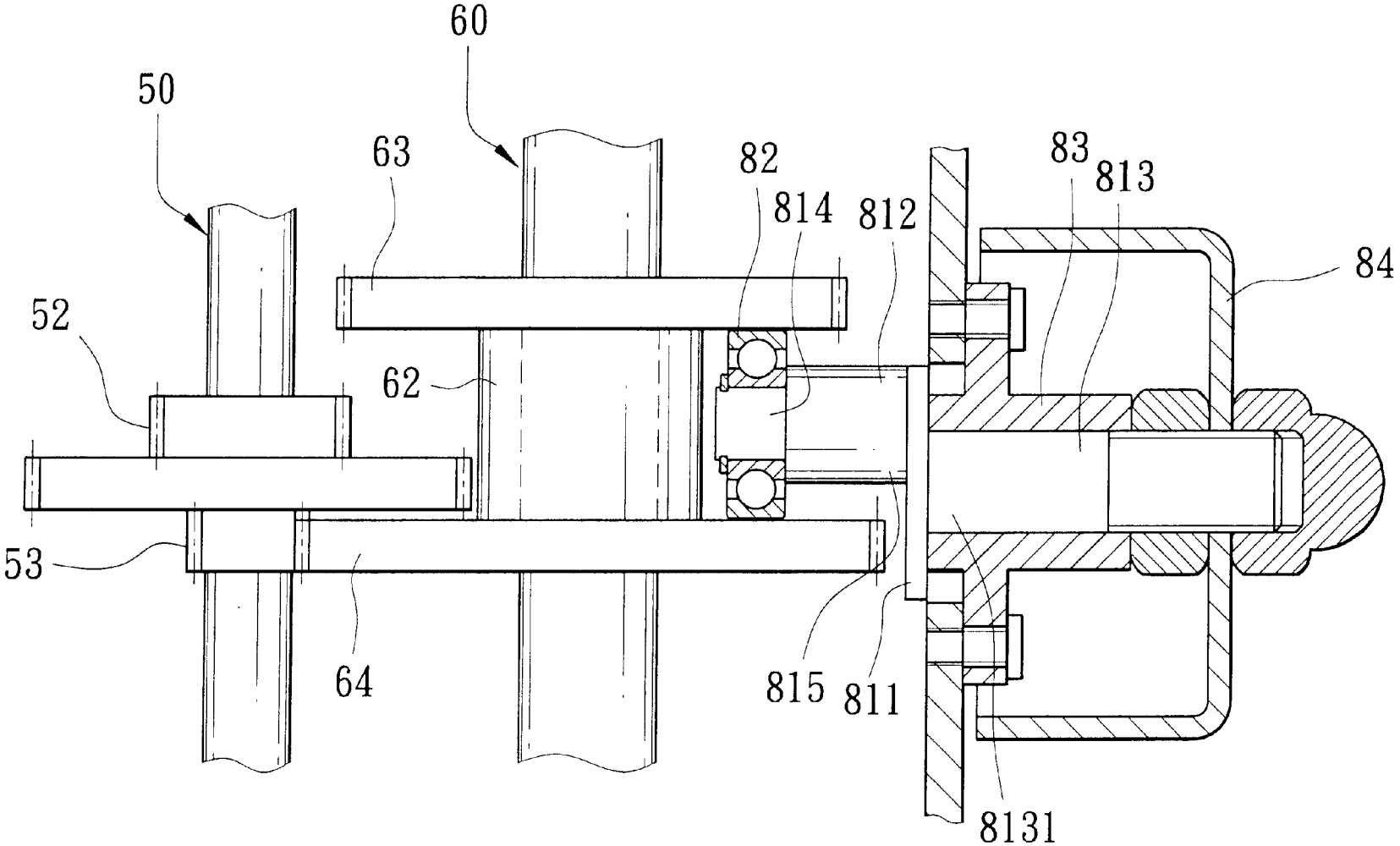
FIG. 8 is a schematic partly sectional view showing the drive transmission shaft in a second position.

A cam member includes a cam plate 811 which engages and which is rotated with the inner actuating end 8131. A transmission lever 812 has a coupling end 815 which is secured on the cam plate 811, and a driving end 814 which extends from the coupling end 815 along an actuating axis offset from the operating axis and which is disposed between the third and fourth gears 63,64. A bearing member 82 is sleeved retainingly on the driving end 814 by a retaining ring 821, and is interposed between the driving end 814 and the third and fourth gears 63,64. Thus, as shown in FIGS. 7 and 8, when the user turns the knob 84 to rotate the inner actuating end 8131 about the operating axis and to rotate the driving end 814 about the actuating axis, the rotating movement of the driving end 814 is transformed into the translational movement of the third and fourth gears 63,64, thereby shifting the sleeve 62 between the first and second positions so as to result in two different reduction drives of the second transmission shaft 60, without the need for removing any one of the gears.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A wood planing machine comprising:

a mounting frame including right and left sides spaced apart from each other in a longitudinal direction;

a worktable for supporting a workpiece thereon, said worktable having feed-in and take-out sides opposite to each other in a transverse direction relative to the upright and longitudinal directions;

a rotatable cutting member having two ends mounted rotatably on said right and left sides to define a rotating axis in the longitudinal direction, and adapted to be driven by a motor to rotate with a rotating force, wherein said worktable is movable relative to said cutting member in an upright direction so as to allow said cutting member to engage said workpiece;

a first transmission shaft extending in the longitudinal direction, and mounted rotatably on said left side about a first axis parallel to the rotating axis;

first and second gears mounted on and rotated with said first transmission shaft about the first axis, said first and second gears having different numbers of teeth;

a first drive transmission member disposed relative to said rotating axis and said first axis to transmit the rotating force of said cutting member to said first transmission shaft;

a second transmission shaft extending in the longitudinal direction, and mounted rotatably on said left side about a second axis parallel to the first axis;

a sleeve splined on and rotated with said second transmission shaft, and having two ends opposite to each other in the longitudinal direction;

third and fourth gears secured respectively on said ends of said sleeve, and having different numbers of teeth such that said sleeve, along with said third and fourth gears, is shiftable along the second axis relative to the said second transmission shaft between a first position, where said third gear meshes with said first gear so as to result in a first reduction drive of said second transmission shaft, and a second position, where said fourth gear meshes with a said second gear so as to result in a second reduction drive of said second transmission shaft;

a feed-in rolling member extending in the longitudinal direction, and mounted rotatably on said right and left sides about a first rolling axis parallel to the first axis and proximate to said feed-in side;

a second drive transmission member disposed relative to said second axis and said first rolling axis to transmit one of the first and second reduction drives of said second transmission shaft to said feed-in rolling member;

an actuating member having an inner actuating end rotatably mounted in said mounting frame about an operating axis radial to the second axis of said second transmission shaft, and an outer operating end extending from said inner actuating end along the operating axis and outwardly of said mounting frame so as to externally operate said inner actuating end to rotate with a rotating force; and a cam member disposed to transform the rotating force of said inner actuating end into a translational force for moving said sleeve along the second axis between the first and second positions.

2. The wood planing machine of claim 1, wherein said first drive transmission member includes a fifth gear mounted on and rotated with said cutting member, a third transmission shaft extending in the longitudinal direction, and mounted rotatably on said left side about a third axis parallel to the first axis, sixth and seventh gears mounted on and rotated with said third transmission shaft and spaced apart from each other in the longitudinal direction, said sixth gear meshing with said fifth gear, and an eighth gear mounted on and rotated with said first transmission shaft and meshing with said seventh gear.

3. The wood planing machine of claim 2, wherein said first, second, third, fourth, fifth, sixth, seventh, and eighth gears form a reducing gear train.

4. The wood planing machine of claim 1, wherein said second drive transmission member includes a first chain wheel mounted on and rotated with said second transmission shaft, a fourth transmission shaft extending in the longitudinal direction, and mounted rotatably on said left side about a fourth axis parallel to the first axis, second and third chain wheels mounted on and rotated with said fourth transmission shaft, and spaced apart from each other in the longitudinal direction, a first chain trained on said first and second chain wheels to transmit the rotating force of said second transmission shaft to said fourth transmission shaft, a fourth chain wheel mounted on and rotated with said feed-in rolling member, and a second chain trained on said third and fourth chain wheels to transmit the rotating force of said fourth transmission shaft to said feed-in rolling member.

5. The wood planing machine of claim 4, further comprising a take-out rolling member extending in the longitudinal direction, and mounted rotatably on said right and left sides about a second rolling axis parallel to the first axis and proximate to said take-out side, said take-out rolling member being spaced apart from said feed-in rolling member in the transverse direction; and a third drive transmission member disposed to transmit the rotating force of said feed-in rolling member to said take-out rolling member.

6. The wood planing machine of claim 5, wherein said third drive transmission member includes a fifth chain wheel mounted on and rotated with said feed-in rolling member and spaced apart from said fourth chain wheel in the longitudinal direction, a sixth chain wheel and mounted on and rotated with said take-out rolling member, and a third chain trained on said fifth and sixth chain wheels to transmit the rotating force of said feed-in rolling member to said take-out rolling member.

7. The wood planing machine of claim 1, wherein said cam member includes a cam plate engaging and rotated with said inner actuating end, a transmission lever having a coupling end secured on said cam plate, and a driving end which extends from said coupling end along an actuating axis offset from the operating axis and which is disposed between said third and fourth gears, and a bearing member interposed between said driving end and said third and fourth gears to facilitate rotation of said driving end relative to said third and fourth gears such that a rotating movement of said driving end by actuation of said inner actuating end is transformed into the translational movement of said third and fourth gears and said sleeve.

* * * * *